US006050881A

United States Patent [19]

Allor et al.

[11] Patent Number: 6,050,881

[45] Date of Patent: Apr. 18, 2000

[54] SURFACE FINISHING COVALENT-IONIC CERAMICS

[75] Inventors: Richard Lawrence Allor, Livonia; Gary Mark Crosbie, Dearborn; Douglas George Mcwatt, Livonia; Arup Kumar Gangopadhyay, Novi, all of Mich.

[73] Assignee: Ford Global Technologies, Inc., Dearborn, Mich.

[21] Appl. No.: 09/122,712

[22] Filed: Jul. 27, 1998

[51] Int. Cl.[7] ..... B24B 1/00

[52] U.S. Cl. ..... 451/41; 451/56; 451/21; 451/443

[58] Field of Search ..... 451/56, 21, 443

[56] References Cited

U.S. PATENT DOCUMENTS

| | | | |
|---|---|---|---|
| Re. 27,081 | 3/1971 | Shockley et al. | 123/193 |
| 3,715,842 | 2/1973 | Tredinnick et al. . | |
| 3,955,327 | 5/1976 | Franco . | |
| 4,234,661 | 11/1980 | Lee et al. . | |
| 4,476,656 | 10/1984 | Bovenkerk | 451/56 |
| 4,695,294 | 9/1987 | Korzekwa et al. . | |
| 4,720,941 | 1/1988 | Belieff et al. . | |
| 4,741,918 | 5/1988 | Nagy de Nagybaczon et al. . | |
| 5,547,414 | 8/1996 | Ohmori | 451/21 |
| 5,643,054 | 7/1997 | Bach et al. . | |
| 5,727,992 | 3/1998 | Blomqvist et al. | 451/56 |
| 5,741,172 | 4/1998 | Trionfetti et al. | 451/21 |

*Primary Examiner*—David A. Scherbel
*Assistant Examiner*—Shantese McDonald
*Attorney, Agent, or Firm*—Joseph W. Malleck

[57] ABSTRACT

Method of surface finishing covalent-ionic ceramics comprising: (a) repeatedly rubbing a finishing medium against an exposed surface of the ceramic, the medium being constituted of an ionic bonded oxide having grains harder than the grains of the covalent-ionic bonded ceramic; (b) interrupting the rubbing at frequent intervals to dress the medium by a single point diamond tool; and (c) continuing the repeated rubbing and dressing interruptions of steps (a) and (b) until a surface roughness of about 0.04 micrometer Ra has been achieved on the ceramic and the exposed surface of the ceramic retains an ionic residue of the finishing medium. Also, a method of effecting reduced friction between lubricated rubbing surfaces, comprising: (a) forming one of the rubbing surfaces of silicon nitride based ceramics having a polished surface roughness about 0.04 micrometer Ra with an ionic residue thereon resulting from finishing with an ionic-bonded oxide having grains harder than the grains of the silicon nitride ceramic; and (b) operating the silicon nitride rubbing surface against the other rubbing surface while lubricating the interface between such rubbing surfaces with oil in a mixed hydrodynamic regime, whereby the ionic residue is effective to react with additives in said lubricant oil to form a transfer film on said silicon nitride ceramic that reduces contact friction.

14 Claims, 4 Drawing Sheets

| SYMBOL LEGEND | | | |
|---|---|---|---|
| Sample | Diamond Finish | Chrome Mech. Finish | $Al_2O_3$ Finish |
| A | ○ | ● | ⊘ |
| B | □ | ■ | ▨ |
| C | △ | ▲ | ◬ |

| Characteristics | Sample A | Sample B | Sample C |
|---|---|---|---|
| Ceramic type | beta silicon nitride | beta silicon nitride | beta silicon nitride |
| Grain boundary phase | Amorphous | Amorphous | Amorphous |
| Sintering additive | Alumina + yttria | Alumina + yttria and magnesia | Alumina + yttria and tungsten carbide |
| Grain Size } Length / Width | 1.5 / 2.0 } coarse | 3 / 0.5 } very fine | 6 / 1 } fine |
| Modulus of rupture MPa | 650 | 1450 | 1000 |
| Weibull modulus | 18 | 15-120 | 15-20 |
| Fracture toughness MPa/m | 6.4 | 5.8 | 7.0 |
| Porosity | Most porous | Least porous | Moderate porosity |
| Degree of homogeneity | Relatively inhomogeneous with inclusions of Ca, Si and Fe | Moderately homogeneous | Very homogeneous with least inclusions |

FIG. 5A

| | | Sample A | Sample B | Sample C |
|---|---|---|---|---|
| Surface Roughness Ra | Diamond Finished | .06 | .05 | .03 (mirror finished) |
| | Chrome Mech. Finished | .04 | .03 | .02 |
| | $Al_2O_3$ Finished | .04 | .04 | .04 |

FIG. 5B

| Characteristic | | Sample A | | | Sample B | | | Sample C | | |
|---|---|---|---|---|---|---|---|---|---|---|
| | | Diamond Finish | Chrome Mech. Finish | $Al_2O_3$ Finish | Diamond Finish | Chrome Mech. Finish | $Al_2O_3$ Finish | Diamond Finish | Chrome Mech. Finish | $Al_2O_3$ Finish |
| Test Surface Roughness (μm) | Ra | .06 | .04 | .04 | .05 | .03 | .04 | .03 | .02 | .04 |
| | Rt | 0.8 | 0.3 | 6.6 | 1.1 | 0.2 | 0.4 | 0.5 | 0.2 | 0.5 |
| | R3z | 0.3 | 0.1 | 0.2 | 0.2 | 0.1 | 0.2 | 0.1 | 0.1 | 0.2 |
| | RP | 0.2 | 0.1 | 0.3 | 0.3 | 0.1 | 0.2 | 0.1 | 0.1 | 0.4 |
| | RV | 0.6 | 0.2 | 0.2 | 0.9 | | 0.2 | 0.4 | | 0.2 |
| Back Surface Roughness (μm) | Ra | .22 | .02 | .15 | .10 | .13 | .07 | .03 | .08 | .03 |
| | Rt | 2.1 | 0.3 | 1.4 | 0.9 | 1.8 | 0.7 | 0.6 | 0.7 | 0.3 |
| | R3z | 1.3 | 0.1 | 0.7 | 0.6 | 0.7 | 0.3 | 0.1 | 0.4 | 0.2 |
| | RP | 0.7 | 0.1 | 0.7 | 0.3 | 0.5 | 0.5 | 0.1 | 0.3 | 0.1 |
| | RV | 1.4 | 0.3 | 0.7 | 0.6 | 1.3 | 0.3 | 0.5 | 0.3 | 0.2 |

FIG. 5C

SURFACE FINISHING COVALENT-IONIC CERAMICS

TECHNICAL FIELD

This invention relates to the technology of finishing structural ceramics, and more particularly to economically finishing bearing surfaces of such ceramics to reduce bearing friction.

DISCUSSION OF THE PRIOR ART

Structural ceramics are being used more frequently for production of various components in engineering and biomedical applications. Cutting tools, metal-forming molds and dies, automotive valves and valve seats, fuel-injection components, water pump seals, turbine blades and liners, rotors, nozzles, read/write computer heads, and artificial hip joints, represent a partial list of components in which ceramics have been successfully implemented. These uses take advantage of certain properties of ceramics, namely, their high resistance to wear and corrosion, low-density and high temperature strength. In automotive engines, ceramics have been used as inserts to present bearing surfaces particularly in the engine valve train (i.e., on cam lobes, direct acting bucket tappets, slider or roller cam followers). Since the valve train as a whole contributes 6–10% of the total frictional losses for an engine, it is desirable to reduce the sliding or rolling contact friction of such ceramic inserts. Disregarding contact friction, very few ceramics meet all the requirements needed for engine valve train inserts, such as high wear resistance, light weight, high bend strength, hardness, fracture toughness, Weibull and Young's modulus, and charpy impact value. Silicon nitride ($Si_3N_4$) is a covalent-ionic bonded solid that does meet such requirements.

Reducing the surface roughness of inserts comprised of silicon nitride based ceramic to a mirror finish (e.g., Ra of 0.02 micrometer is one hope of attaining reduced friction. However, the accepted art forms for polishing ceramics requires either (i) diamond polishing, which generates sufficient heat at the contact zone to cause plasticity in the ceramic, thereby producing a very smooth surface, or (ii) a chemo-mechanical technique which presses a rotating iron wheel against the ceramic in the presence of oxidizing acid, so that the pressure and acid action will bring about smoothness. The problem with diamond polishing is its extreme expense which constitutes more than 50% of the cost of preparing the ceramic. The problem with chemo-mechanical treatments is the inability to obtain desirable levels of friction in spite of attaining mirror finishes.

SUMMARY OF THE INVENTION

It is an object of this invention to provide a more economical process for finishing covalent-ionic solids, such as silicon nitride based ceramic, so that the solid can present a non-mirror finish bearing surface and still attain friction levels at least as low as that attained with diamond polishing.

It is also an object of this invention to provide a lubricated ceramic bearing system that achieves improved friction performance equal to or greater than that obtained with techniques of the prior art while doing so at lower cost for polishing the ceramics.

It is yet still another object of this invention to provide a process for finishing covalent-ionic ceramics so that when used in an oil lubricated friction bearing assembly, the ceramic combines with oil additives to form a transfer film on the ceramic that contributes to lower contact friction.

The invention, in a first aspect, is a method of surface finishing covalent-ionic ceramics comprising: (a) repeatedly rubbing a finishing medium against an exposed surface of the ceramic, the medium being constituted of an ionic bonded oxide having grains harder than the grains of the covalent-ionic bonded ceramic; (b) interrupting the rubbing at frequent intervals to dress the medium by a single point diamond tool; and (c) continuing the repeated rubbing and dressing interruptions of steps (a) and (b) until a surface roughness of about 0.04 micrometer Ra has been achieved on the ceramic and the exposed surface of the ceramic retains an ionic residue of the finishing medium.

The invention, in a second aspect, is a method of effecting reduced friction between lubricated rubbing surfaces, comprising: (a) forming one of the rubbing surfaces of silicon nitride based ceramic having a polished surface roughness of about 0.04 micrometer Ra with an ionic residue thereon resulting from finishing with an ionic-bonded oxide having grains harder than the grains of the silicon nitride based ceramic; and (b) operating the silicon nitride rubbing surface against the other rubbing surface while lubricating the interface between such rubbing surfaces with oil in a hybrid or mixed hydrostatic-hydrodynamic regime, whereby the ionic residue is effective to react with additives in said lubricant oil to form a transfer film on said silicon nitride based ceramic that reduces contact friction.

BRIEF DESCRIPTION OF THE DRAWINGS

FIG. 5*a* is a tabular listing of physical and mechanical characteristics of the inserts used in FIG. 4;

FIG. 5*b* is a tabular casting of average surface roughness for the finished inserts used in FIG. 4; and FIG. 5*c* is a tabular listing of detailed surface roughness characteristics of each of the inserts used in FIG. 3.

DETAILED DESCRIPTION AND BEST MODE

Figure 1:
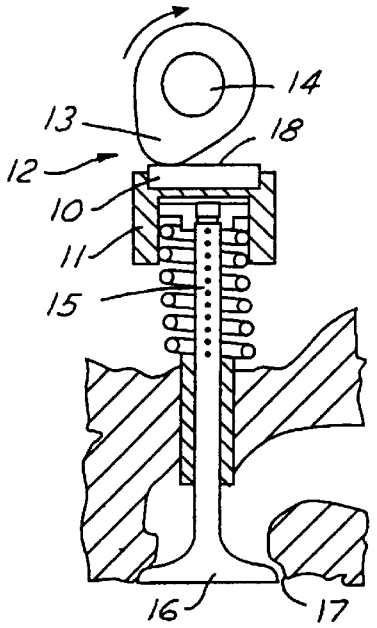
FIG. 1 is a schematic broken view of one valve operating system using a flat covalent-ionic bonded ceramic flat insert finished in accordance with this invention.

Bearing surfaces, particularly in powertrain components, need to have the friction torque level reduced in a more economical and simple way. As shown in FIG. 1, it is considered an improvement to use a smooth ceramic insert or shim 10 on tappets 11, as one of the bearing surfaces of a valve train bearing couple 12 where the other bearing surface is a steel lobe 13 on a rotating camshaft 14. There is an essentially continuous sliding contact with the shim 10 as the irregular lobe 13 turns and moves the spring biased valve stem 15 up or down to open or close the engine valve 16 with respect to an intake or exhaust port 17. Prevailing known techniques for reducing friction of the shims 10 involves polishing the exposed surface 18 of the ceramic insert 10 to an ultra smooth finish by use of a very expensive diamond polishing medium.

Figure 2:
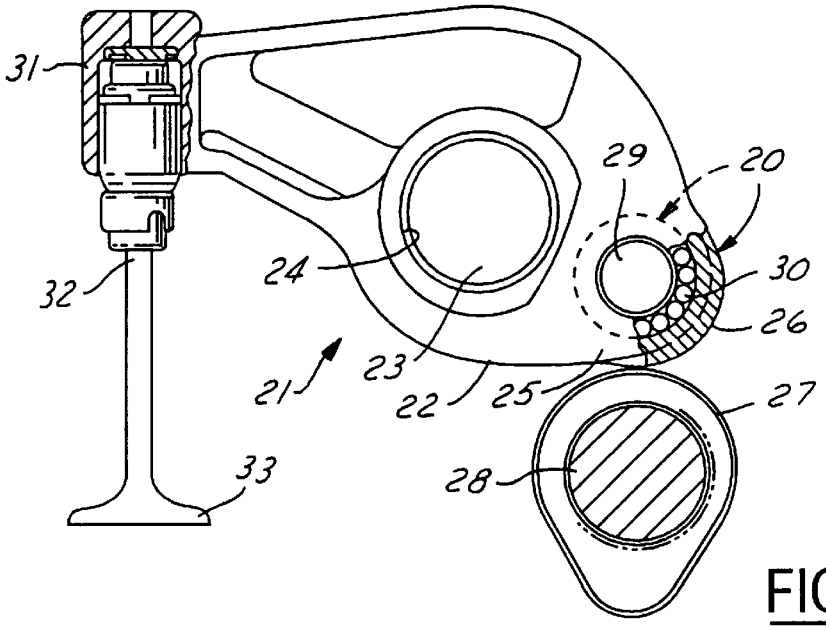
FIG. 2 is a schematic illustration of another valve operating system using a covalent-ionic bonded ceramic roller, which roller was finished in accordance with this invention.

As shown in FIG. 2, ceramic rollers 20 may be substituted for steel rollers in a cam follower valve train 21, where a rocker arm 22 pivots about a rocker shaft 23 received in a through-bore 24 of the rocker arm. An interior recess at end 25 of the rocker arm receives the ceramic roller 20 which has an outer surface 26 in continuous rolling contact with camming lobe 27 on a rotating camshaft 28. The roller 20 may be mounted on its own shaft 29 in a recess of the arm by a plurality of needle bearings 30. The other end 31 of the rocker arm is in engagement with valve stem 32 to open and close the valve 33. Although ceramic rollers reduce the amount of sliding friction encountered between the steel lobe 27, there still remains some sliding friction which cannot be eliminated. Therefore, it is also conventional to polish the ceramic roller outer surface to an ultra smooth finish by use of expensive diamond polishing media.

This invention has discovered that the use of common ionic-bonded aluminum oxide, in place of diamond (as a polishing medium for surfaces of covalent-ionic ceramics, such as silicon nitride) achieves equivalent ultra smooth finishing. When used with one of the rubbing surfaces in an oil lubricated bearing couple with metals, such as steel, the common ionic-bonded aluminum oxide will produce lower friction torque for the bearing couple, even though the polished surface is not as smooth as a mirror finish.

Figure 3:
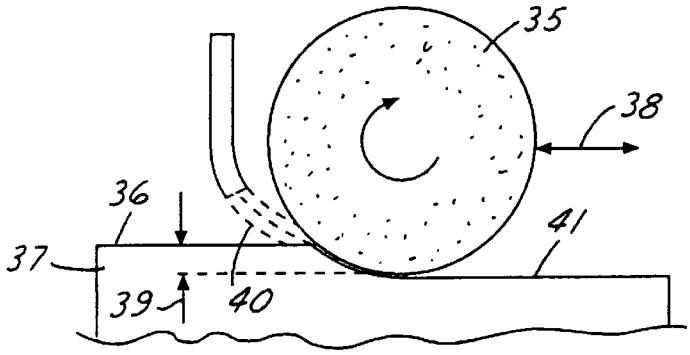
FIG. 3 is a schematic illustration of how an ionic-bonded oxide wheel is used to finish silicon nitride inserts in accordance with this invention.

As shown in FIG. 3, a preferred mode for carrying out the method of surface finishing according to this invention is to (i) repeatedly rub a finishing medium (in the form of a rotating resin-bonded aluminum oxide wheel 35) against an exposed surface 36 of a covalent-ionic bonded ceramic insert shim 37 (or roller); (ii) interrupting the rubbing at frequent intervals to dress the medium of wheel 35 by a single point diamond tool and (iii) continuing the repeated rubbing and dressing interruptions of steps (i) and (ii) until a surface roughness of about 0.04 micrometer has been achieved on the ceramic and the exposed surface of the ceramic retains an ionic residue of the finishing medium.

Preferably, the ceramic is comprised of beta silicon nitride needles having an amorphous grain boundary phase containing yttria and alumina as sintering additives. The grain size can vary in width between 0.5–2.0 micrometers and the length can vary between 0.5–20 micrometers. Other covalent-ionic ceramics with which this process can be utilized, include sialon, beryllium oxide, silicon oxynitride, aluminum oxynitride, and nitrogen containing silicates. The ionic-bonded aluminum oxide in wheel 35 can have a grain size of about 46 to 60 grit and the resin is preferably comprised of conventional, non-vitrified polymeric/resin.

Repeated rubbing is carried out by dragging the rotating aluminum oxide wheel 35 across the exposed ceramic surface 36 in repeated passes 38 with increasing incremental downfeeds 39, while flooding the contact area with a fluid coolant 40, such as a water soluble oil. Preferably, the incrementally increasing downfeeds are each about 0.001 inch with a traverse rate for each of the passes being about 48 inches per minute. The total number of passes is preferably limited to about 10–12 before dressing of the wheel is accomplished. Dressing is effected by using a wheel grit size of 46–60. Dressing is important because it affects the flatness of the resulting surface.

The rubbing and dressing sequence is carried out until an average surface roughness of about 0.04 micrometers, measured by a stylus profilometer, is obtained. The starting surface roughness of surface 36 is usually about 0.15–0.07 micrometer. The achieved polished surface roughness of surface 41 is less than a mirror finish (mirror being usually about 0.02 micrometer).

During the polishing activity, it is believed that the silicon nitride based ceramic mechanically exchanges particles with the aluminum oxide, leaving an ionic residue of aluminum oxide on the silicon nitride. This residue has been found to play an important role in reducing friction torque in a fluid lubricated bearing assembly, by the formation of a thin film with the additives that may be contained in the fluid lubrication.

The invention thus, in a second aspect, is a method of effecting reduced friction between lubricated rubbing surfaces, comprising: (i) forming one of the surfaces of a silicon nitride based ceramic having a polished surface roughness of about 0.04 micrometer with an ionic residue thereon resulting from finishing with an ionic-bonded oxide having grains harder than the grains of the silicon nitride; (ii) operating the silicon nitride rubbing surface against another rubbing surface with the interfacing surfaces oil lubricated, said rubbing surfaces causing the lubrication to operate in a hybrid hydrostatic-hydrodynamic regime whereby the ionic residue is effective to combine with additives in said oil lubricant and form a transfer film on the silicon nitride based ceramic rubbing surface to reduce contact friction.

The fluid oil medium can be a conventional modern engine oil (5W30) chemically comprising petroleum fractions with additives containing elements such as zinc, sulfur, phosphorus (zinc dithio-phosphate) and calcium. As a result of this second aspect of the invention, the friction torque will be generally about the same as that obtained with mirror finished diamond polished silicon nitride, even though the measured roughness of the aluminum oxide polished silicon nitride based ceramic is slightly greater.

Comparative tests were undertaken to corroborate this phenomenon of friction reduction in a lubricated bearing assembly. Three sample types of silicon nitride based ceramics were used, varying in quality as to the type of sintering additives, grain size, porosity and homogeneity. Such characteristics of the samples, along with certain physical properties, are listed in FIG. 5*a*. All three sample materials contained needles of beta silicon nitride with an amorphous grain boundary phase. The needle dimensions varied from the coarsest in Sample A to the finest in Sample C. Each silicon nitride included yttria as a sintering additive. Other constituents in the silicon nitride material included alumina and magnesia. Alumina is present in all of the silicon nitride materials tested, but the highest amount was present in Sample A, where there is more alumina than yttria. Magnesia appears only in Sample C and the amount of magnesia is about at the same level as that of the alumina. Sample B contained tungsten carbide presumably from contamination in milling the starting silicon nitride powder used to make this sintered silicon nitride.

Specimens of each of the sample types were subjected to different polishing or finishing techniques, and the resulting surface roughness was measured and compared as set out in FIG. 5*b*. The different techniques comprised, first, use of a diamond polishing wheel (characteristic of the prior art) having diamond grit in the grit size range of 0.1 to 1 micrometer; secondly, use of a chemical-mechanical technique in accordance with the prior art where a cast iron polishing wheel is pressed against the target silicon nitride ceramic while flooding the contact area with an oxidizing acid; and thirdly, use of ionic-bonded aluminum oxide as a wheel having a grit size in the range of 46–60 grit. The diamond finishing technique, used for Sample C, was of the type called mirror finishing wherein the rubbing is carried out to obtain an optically reflective surface. The ability to produce an optically reflective surface depends in part on the microstructure of the ceramic (requiring a small homogeneous grain) and light, delicate downfeeds of a finishing wheel having such small grain size.

The data set forth in FIG. 5*b* demonstrate that regardless of the grain size or porosity of the silicon nitride based ceramic being treated, a more consistently smooth surface (0.04 micrometer Ra) can be obtained by using a finishing wheel comprised of aluminum oxide. Such use of aluminum oxide does not obtain a roughness that is an optically mirror-like finish.

FIG. 5*c* adds more detailed surface roughness data for different types of roughness measurements. The surface roughnesses of all inserts were measured in two orthogonal directions before and after tests using a stylus profilometer to monitor changes in the surface roughness. You will note that in FIG. 5*c*, Ra represents a centerline average roughness, Re represents maximum peak to valley height; R3z represents the mean third point height peak to valley; Rp represents maximum peak height; and Rv represents maximum valley depth.

Figure 4:
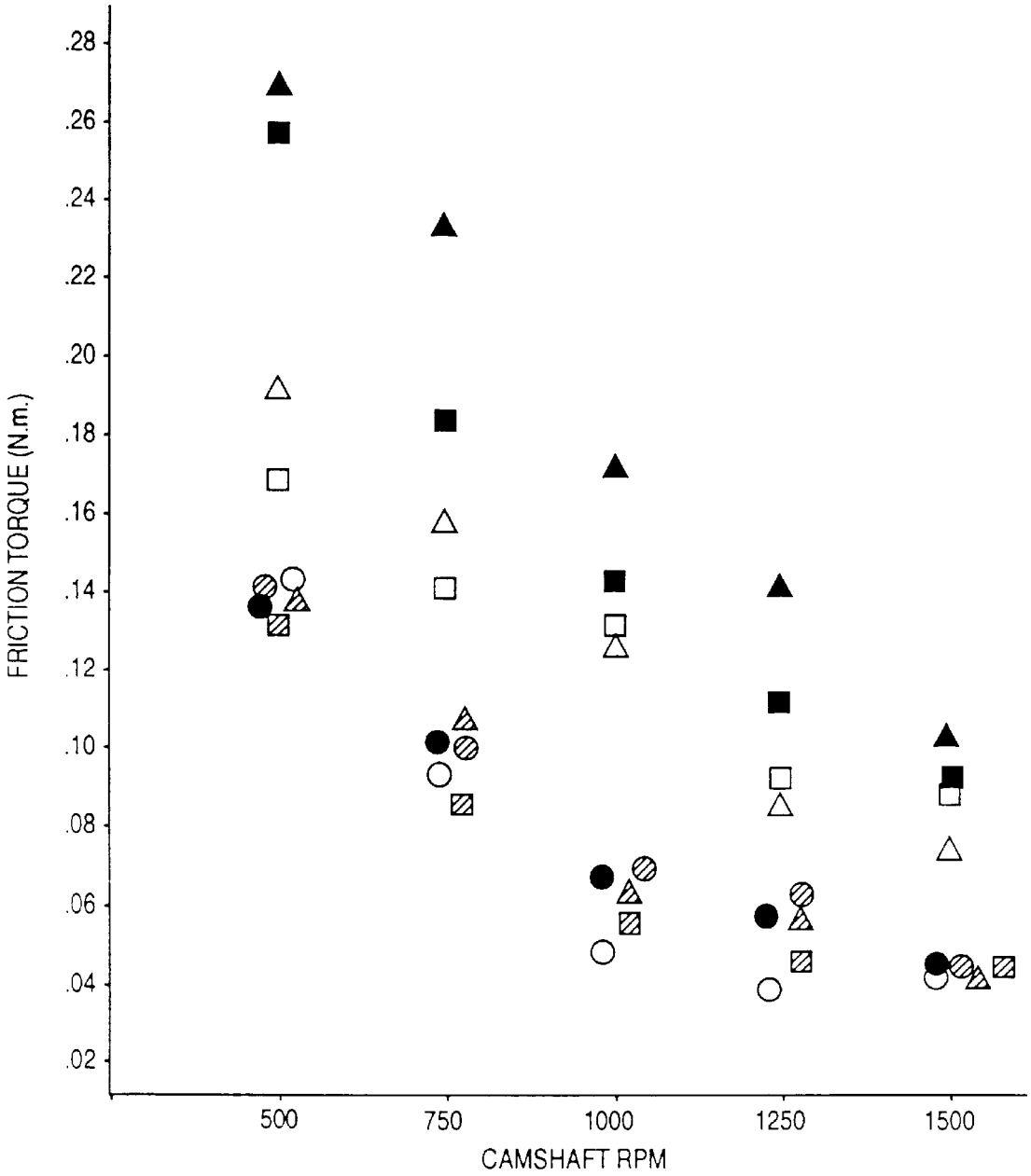
FIG. 4 is a plot of friction torque as a function of camshaft rpm, for nine different silicon nitride based ceramic inserts, six of which had their exposed rubbing surfaces finished in accordance with prior art techniques, and the remaining three were polished in accordance with this invention.

When such sample types were tested in a lubricated cam/tappet test rig in a manner to effectively simulate lubricated valve train rubbing action, results plotted in FIG. 4 showed that the silicon nitride based ceramic shims, finished with an aluminum oxide surface finishing medium, surprisingly resulted in a lower lubricated operating friction in a steel-silicon nitride ceramic bearing couple, even though the finished surface was rougher than a mirror finish. The test rig consisted essentially of a single (steel) cam lobe from a Ford Motor Company 2.0 liter Zetec engine which was rotatingly driven by a 2 horsepower electric motor; the cam was driven to engage a direct acting mechanical bucket tappet with a removable insert comprised of the finished silicon nitride ceramic. A steel valve having a mass equivalent to a production valve was used with a production valve spring. The cam lobe/insert contact was lubricated with a jet of conventional modern engine oil (5W30) at 100° C. and 30 psi after at least 30 minutes. The friction torque was measured by a transducer mounted in-line with the driveshaft. The friction torque data was averaged over 17 cycles. The average friction torques were collected at cam lobe speeds of 500, 750, 1000, 1250, and 1500 rpm. In general, friction torque decreased with increasing speed due to the change of the lubrication regime from boundary to a more mixed hydrodynamic condition.

Diamond finished and chemical-mechanical finished samples showed consistently higher friction torque than that of the aluminum oxide finished samples. Only Sample A finished by diamond or chemical-mechanical treatments exhibited equivalent friction torque levels at all operating camshaft speeds with the aluminum oxide treated material. Interestingly, the chemical-mechanical treatment for Samples B and C had the lowest initial average surface roughness, but showed comparatively very high friction torque. The lower friction torque and excellent performance of the $Al_2O_3$ polished samples are believed to be attributable to an ionic residue on the polished surface of the silicon nitride ceramic, which when subjected to a hot lubricated steel ceramic bearing couple, seems to promote a chemical transfer film on the sliding area of the silicon nitride, which either smoothes out the silicon nitride bearing surface (peaks and valleys), or presents microscopic compounds formed between aluminum oxide and the additive elements in the lubricating oil, such as zinc, phosphorus, sulfur and calcium, that act as interfacial solid lubricants.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

What is claimed is:

1. A method of surface finishing covalent-ionic ceramics comprising:

(a) repeatedly rubbing a finishing medium against an exposed surface of said ceramic, said medium being constituted of an ionic-bonded oxide having grains harder than the grains of said covalent-ionic ceramic;

(b) interrupting said rubbing at frequent intervals to dress said medium; and (c) continuing the repeated rubbing and dressing interruptions of steps (a) and (b) until an average surface roughness of about 0.04 micrometer Ra has been achieved on said ceramic while the exposed surface of said ceramic retains an ionic residue of the finishing medium.

2. The method as in claim 1 in which said ionic-bonded oxide is aluminum oxide.

3. The method as in claim 1, in which said covalent-ionic ceramic is selected from the group of silicon nitride, sialon, beryllium oxide, silicon oxynitride, aluminum oxynitride, and nitrogen-containing silicates.

4. The method as in claim 1, in which step (a) is carried out by forming the medium as a rotating wheel and said rotating wheel is dragged across said exposed surface in minute incremental downfeeds.

5. The method as in claim 4, in which each incremental downfeed is about 0.001 inch per pass, and the wheel is dragged across the ceramic at a traverse rate of about 48 inches per minute.

6. The method as in claim 1 in which said ionic residue is comprised of $Al_2O_3$ or aluminum hydroxide.

7. The method as in claim 1, in which said finishing medium is comprised of chromium oxide.

8. The method as in claim 1, in which said finishing medium is comprised of rare earth oxides.

9. The method as in claim 1, in which step (b) is carried out with said lubrication formed as a jet of oil directed at the interface, the oil having a temperature of about 100° C. and a pressure of about 30 psi.

10. A method of effecting reduced friction between lubricated rubbing surfaces, comprising the steps of:

(a) forming one of said surfaces of silicon nitride based ceramic having a polished surface roughness of about 0.04 micrometer with an ionic residue thereon resulting from finishing said surface with an ionic-bonded oxide having grains harder than the grains of said silicon nitride ceramic; and (b) operating said silicon nitride rubbing surface against the other rubbing surface while lubricating the interface between said rubbing surfaces with oil in a mixed hydrodynamic regime whereby the ionic residue is effective to react with additives in said lubricating oil to form a transfer film on the silicon nitride ceramic that lowers the friction torque of said rubbing surfaces.

11. The method as in claim 10, in which the other rubbing surface is an iron-based metal.

12. The method as in claim 10, in which said ionic-bonded oxide is aluminum oxide.

13. The method as in claim 10, in which said silicon nitride ceramic rubbing surface is part of a bucket tappet insert effective to be operated against a steel cam of an engine camshaft.

14. The method as in claim 10, in which said oil medium is a conventional modern engine oil, such as 5W30.

* * * * *